US009491985B2

(12) United States Patent
Lubart

(10) Patent No.: US 9,491,985 B2
(45) Date of Patent: Nov. 15, 2016

(54) OUTSOLE TREAD PATTERN

(71) Applicant: Shoes For Crews, LLC, West Palm Beach, FL (US)

(72) Inventor: Randy N. Lubart, Palm Beach Gardens, FL (US)

(73) Assignee: Shoes For Crews, LLC, West Palm Beach, FL (US)

( * ) Notice: Subject to any disclaimer, the term of this patent is extended or adjusted under 35 U.S.C. 154(b) by 185 days.

(21) Appl. No.: 14/080,123

(22) Filed: Nov. 14, 2013

(65) Prior Publication Data

US 2015/0128455 A1 May 14, 2015

(51) Int. Cl.
*A43B 5/00* (2006.01)
*A43C 15/00* (2006.01)
*A43B 13/22* (2006.01)

(52) U.S. Cl.
CPC ..... *A43B 13/22* (2013.01); *A43B 13/223* (2013.01); *A43C 15/00* (2013.01)

(58) Field of Classification Search
CPC .. A43B 13/223; A43B 13/22; A43B 13/226; A43B 13/26; A43C 15/00
USPC ..... 36/25 R, 59 C, 134; D2/951, 957, 960
See application file for complete search history.

(56) References Cited

U.S. PATENT DOCUMENTS 3,717,943 A 2/1973 Orndorff, Jr.
4,202,116 A 5/1980 Dassler
4,274,211 A 6/1981 Funck
4,455,765 A 6/1984 Sjosward
6,076,283 A 6/2000 Boie
D427,757 S * 7/2000 Ruth ..... D2/951
6,705,027 B1 * 3/2004 Campbell ..... A43B 5/001 36/127
7,047,672 B2 5/2006 Hoffer et al.
7,101,604 B1 9/2006 Minges
7,610,695 B2 * 11/2009 Hay ..... A43B 7/14 36/114
D605,838 S * 12/2009 Foust ..... D2/951
7,703,221 B2 4/2010 Richards et al.
8,322,050 B2 12/2012 Lubart
2002/0078598 A1 * 6/2002 Bell ..... A43B 13/223 36/59 R
2002/0144429 A1 * 10/2002 Hay ..... A43B 7/1425 36/25 R
2009/0090031 A1 4/2009 Jung
2009/0188132 A1 7/2009 Fujikawa et al.
2009/0307932 A1 * 12/2009 Kirby ..... A43C 15/00 36/134
2011/0247243 A1 * 10/2011 Eder ..... A43B 13/26 36/67 A
2012/0260535 A1 * 10/2012 Tsang ..... A43B 13/26 36/32 R
2013/0067777 A1 * 3/2013 Minami ..... A43B 13/22 36/59 R

FOREIGN PATENT DOCUMENTS

GB 2068707 8/1981
WO WO2009146231 12/2009

* cited by examiner

*Primary Examiner* — Jila M Mohandesi
(74) *Attorney, Agent, or Firm* — McHale & Slavin, P.A.

(57) ABSTRACT

A footwear sole includes an upper surface and a lower surface. The lower surface includes a plurality of tread members formed thereon. The tread members include a plurality of projections or lugs of various sizes and shapes which are grouped together into specific patterns. The material from which the projections are formed increases the shoe sole's ability to resist slipping on floor surfaces which are covered with oil, water, soap, snow, ice, etc. The shape and pattern of the projections or lugs enable them to channel fluids and penetrate hard slick surfaces to increase the footwear outsole's ability to resist slipping.

19 Claims, 20 Drawing Sheets

OUTSOLE TREAD PATTERN

RELATED APPLICATIONS

This application is related to U.S. Design application Ser. No. 29/465,912, filed Sep. 3, 2013; entitled "FOOTWEAR UPPER"; U.S. Design application Ser. No. 29/465,922, filed Sep. 3, 2013; entitled "FOOTWEAR TREAD"; and U.S. Design application Ser. No. 29/465,931, filed Sep. 3, 2013, entitled "FOOTWEAR TREAD", the contents of which are incorporated herein by reference.

FIELD OF THE INVENTION

The present invention relates generally to footwear, and in particular to a sole construction for use in footwear such as boots, shoes, sandals or the like.

BACKGROUND OF THE INVENTION

A shoe is an item of footwear intended to protect and comfort the human foot while doing various activities. Shoes are also used as an item of decoration. The design of shoes has varied enormously through time and from culture to culture, with appearance originally being tied to function. Additionally, fashion has often dictated many design elements, such as whether shoes have very high heels or flat ones. Contemporary footwear varies widely in style, complexity and cost. Basic sandals may consist of only a thin sole and simple strap. High fashion shoes may be made of very expensive materials in complex construction and sell for thousands of dollars a pair. Other shoes are for very specific purposes, such as boots or shoes specially designed for workers or heavy outdoor use.

A boot is a special type of shoe which covers the foot and the ankle and extends partially up the leg, sometimes as far as the knee or even the hip. Most boots have a heel that is clearly distinguishable from the rest of the sole, even if the two are made of one piece. They are typically made of leather or rubber, although they may be made from a variety of different materials. Boots are worn both for their functionality for protecting the foot and leg from water, snow, mud or hazards, providing additional ankle support for strenuous activities or providing traction to a particular type of surface, as well as for reasons of style and fashion. Boots are designed to withstand heavy wear to protect the wearer. They are generally made from sturdy leather uppers and non-leather outsoles. They may be used for uniforms of the police or military, as well as for protection in industrial settings such as mining and construction. Protective features may include steel-tipped toes, soles or ankle guards and nonslip soles for interaction with slick surfaces.

Traction or grip to a ground surface is beneficial for a work shoe or boot to provide for worker safety. Workers often perform their duties on a greasy, ice covered, wet or damp surface. For example, many industries or companies utilize floors which are covered by materials which resist the penetration of fluids or other substances. These materials are utilized so that any substances inadvertently spilled on the floor can be quickly and completely removed from the floor. One of the drawbacks to these types of floor coverings is that whenever water or other fluids are spilled on these floors, they become very slippery. Examples of this are the floor coverings utilized in restaurants, hotels, hospitals and other institutions. Outdoor workers often encounter snow or ice covered surfaces during the course of their regular work day. Even employees that commute to the work place encounter ice covered sidewalks and wet floors just getting to the workplace. Thus, what is needed is a shoe outsole that can be utilized with a wide variety of shoe types which will provide protection from slip and falls whenever wet, icy or grease covered floors are encountered.

DESCRIPTION OF THE PRIOR ART

Many different shoe soles have been proposed to prevent an individual from slipping. In U.S. Pat. No. 3,717,943 the sole of a boot or overshoe is made from rubber and includes fins and grooves. The fins cooperate with the grooves to trap air within the grooves. The air facilitates the self cleaning feature of the boots which removes mud and other substances from the soles of the boots.

U.S. Pat. No. 4,202,116 discloses a tread for a sport shoe which includes a sole having projections extending outwardly from a tread surface. The tread includes a one-piece, thin walled, metal part with at least two separate, dimensionally reinforced surface sections bearing the integrally molded projections. The reinforced surface includes a plurality of embossed, smooth-surfaced and beveled projections. The metal part is fixedly secured to an inner surface of the shoe sole by either a thin wire grid embedded in the synthetic resin sole or uniformly distributed perforations.

U.S. Pat. No. 4,274,211 discloses a shoe sole made of flexible rubber material with a non-slip profile. The sole includes a plurality of various sized projections or layered elements. The elements include surfaces which are made from materials that are slip resistant. In addition to being slip resistant, the structure and spacing of the projections prevents the accumulation of mud and other debris on the soles of the shoes.

U.S. Pat. No. 4,555,765 discloses a sport shoe sole that possesses a high coefficient of friction along certain portions of the sole while other portions of the sole are formed of a compressible and resilient material that is harder than the material of the rest of the sole.

U.S. Pat. No. 7,047,672 discloses a shoe sole which is designed to be used on a sand surface. The sole is made from a compressed material having an upper surface and a lower surface. A peripheral lip projects downwardly from the lower surface of the sole. A plurality of fins also project downwardly from the lower surface. This type of construction enables efficient propulsion in sandy environments.

U.S. Published Patent Application No. 2009/0188132 discloses a slip resistant shoe sole which includes a plurality of ground contacting projections. The ground contacting projections are V-shaped and are spaced from one another by a predetermined distance in a longitudinal direction of the sole of the shoe. The V-shaped projections also include reinforcements at their base. The projections are made from an elastomeric polymer with a specific JIS-A hardness. This material increases the shoe's ability to resist slipping, and the shape of the projections increases their resistance to avoid bending and deformation.

U.S. Pat. No. 7,703,221 discloses a sole assembly for a shoe which includes a flexible base having an underside surface which includes a forward region, a rearward region, and an intermediate region therebetween. The sole includes a plurality of individual sole elements on the underside thereof. Each element includes a body portion and a connecting section which is operatively secured to the underside surface of the flexible base. The sole elements are arranged on the underside surface of the flexible base such that adjacent sole elements have overlapping sections.

U.S. Pat. No. 8,322,050, to the present inventor, discloses a slip resistant outsole that includes chevron shaped treads for channeling water and grease away from the ground engaging treads.

However, none of the prior art teaches or suggests a shoe outsole that is suitable for use on a wide variety of footwear to work on wet or grease covered surfaces as well as icy surfaces.

SUMMARY OF THE INVENTION

The present invention provides an outsole for a shoe, and more particularly an outsole particularly suited for a work type shoe. The ground engaging surface of the outsole includes a plurality of tread members formed thereon. The tread members include projections or lugs of various shapes which are grouped together into specific patterns for engaging different types of surfaces. The material from which the projections are formed increases the shoe sole's ability to resist slipping on floor surfaces which are covered with oil, water, soap, ice, snow, etc. The shape and pattern of the projections or lugs enable them to control flexing and engagement to the floor surface. This increases the footwear sole's ability to resist slipping. In particular, the outsole is provided with one type of tread that is specifically designed to function similar to a squeegee to channel liquids away from the tread so that the rubber compound may adhere to the floor surface, while another tread design functions to create a high pressure zone for surface penetration of gelatinous or frozen coatings on a floor surface.

Accordingly, it is an objective of the instant invention to provide a slip resistant outsole for footwear which enables an individual to safely walk on smooth floor surfaces and/or floor surfaces which are covered with water, oil, soap, etc.

It is a further objective of the instant invention to provide a slip resistant outsole for footwear which enables an individual to safely walk on smooth floor surfaces and/or floor surfaces which are covered with ice, snow or viscous material.

It is yet another objective of the instant invention to provide a footwear outsole which includes a plurality of tread members that are constructed and arranged to channel water from between the ground engaging tread and the floor surface.

It is a still further objective of the invention to provide a footwear outsole which includes a plurality of tread members that are constructed and arranged to penetrate hard or gelatinous ground or floor coatings.

A still yet further objective of the present invention is to provide a footwear outsole that includes a plurality of tread members including a penetrating member surrounded by surface engaging projections to penetrate floor coverings and thereafter engage the surface.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
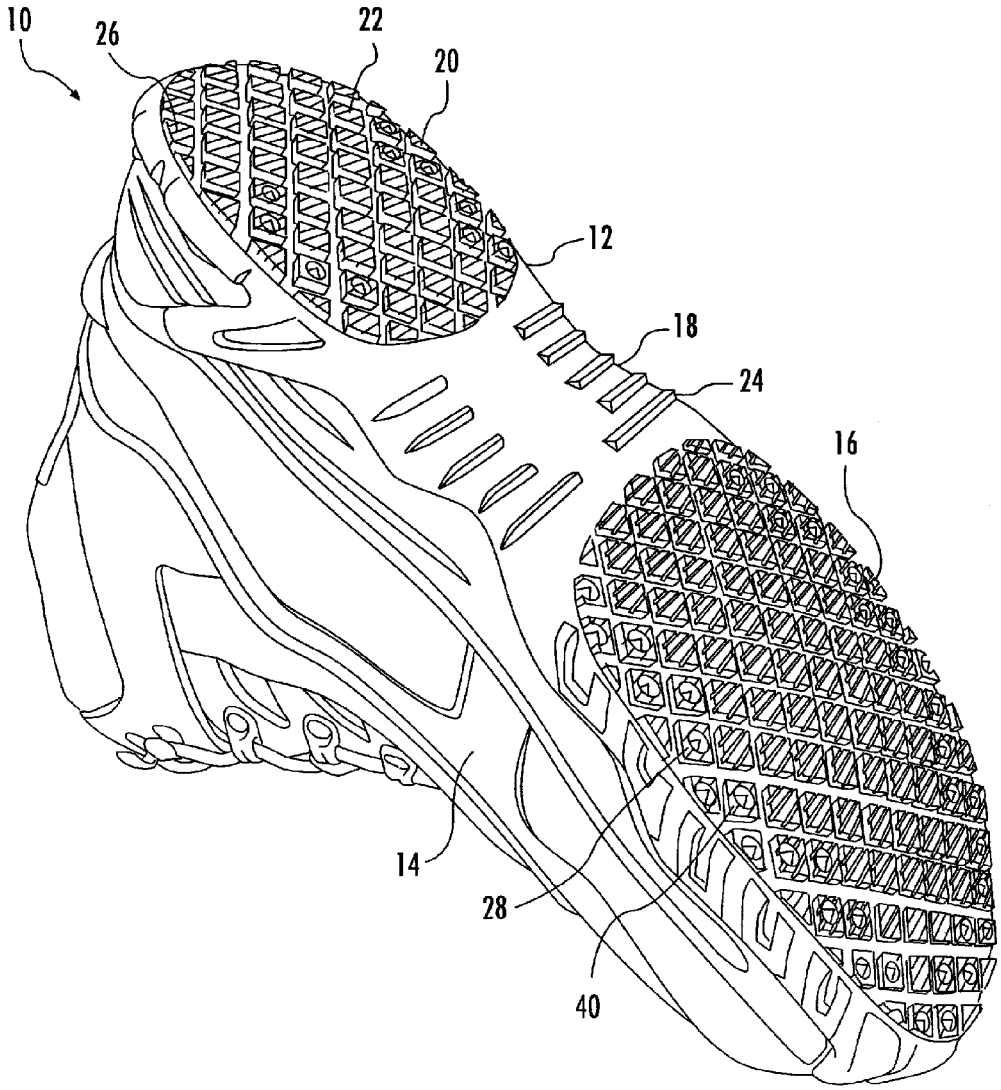
FIG. 1 is a bottom perspective view of a work type shoe utilizing an outsole with tread members of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1-2 and 16-20, an article of footwear 10 having an outsole 12 for various environments is illustrated. The footwear includes an upper 14 for securing the footwear to the user's foot and providing comfort to the user. The upper may be of any design suitable for use by a person. In a particularly desired embodiment, the upper 14 is constructed in the form of a work type shoe or boot as illustrated. In this embodiment, the upper extends over the user's ankle to provide support and protection. In addition, the upper 14 may include insulation (not shown) and protective toe portions (not shown) to provide additional protection to the user. The outsole 12 is the portion of the footwear that contacts the ground surface and therefore provides traction to the user to prevent slips and falls. Traction is provided by the outsole in two very distinct manners. The first requires the tread members to penetrate the ground or working surface so that traction is provided by the side surfaces of the tread members. The second method of providing traction to an article of footwear is to utilize a polymeric rubber compound that allows the upper surface of the outsole to conform, at least partially, to small ground surface imperfections which causes the rubber compound of the outsole to adhere to the surface. The teachings of the present outsole utilize both the ability to penetrate softer and gelatinous surface coverings, while the outsole is constructed from a slip resistant polymeric material having a durometer reading which conforms to surface imperfections for adherence to the working surface. In a preferred embodiment, the present tread members are made from a unique slip resistant polymeric material. The slip resistant material has a hardness of about 0.49 Shore, based on tests performed on a Durometer Hardness Tester. The material also has a slip resistance rating of 0.56-0.65 when tested on a Brungraber Mark 2 Articulated Strut Slip Testing Device. A slip resistant surface is defined as a surface having a rating of 0.50 or higher when tested on the Brungraber Mark 2 Articulated Strut Slip Testing Device.

The outsole includes a forefoot portion 16, a midfoot portion 18 and a heel portion 20. In the preferred embodiment, the forefoot and heel portions include unique tread members 22, while the midfoot portion of the outsole includes blade members 24. The tread members are arranged in a predetermined pattern to provide traction to a user across a variety of surfaces, and are particularly suited for traction on wet or greasy smooth surfaces as well as snow or ice covered surfaces. This provides a unique combination for workers such as those in the restaurant industry which may be required to work in the kitchen area as well as make frequent trips outdoors. To accomplish this ability to function in a superior manner on multiple surfaces, the outsole is provided with two distinct tread member constructions. The first tread 26 is particularly suited for channeling water and/or grease from a smooth surface so that the rubber compound can achieve adherence to the smooth surface. The second tread 110 is particularly suited for penetrating harder materials on a smooth surface such as snow, ice or gelatinous grease. In one particular embodiment, the first and second treads 110 are arranged on the outsole to provide maximum effectiveness whereby the first tread members 26 are positioned in the central or higher weight bearing portions of the outsole while the second treads 110 are positioned around the periphery of the outsole 12 where the user would "dig in" a portion of their footwear to achieve a foothold, especially when the area being utilized is less than the size required to place the entire outsole. In these instances, users often dig in the toe, side or heel portion of the shoe in an attempt to prevent slipping.

Figure 2:
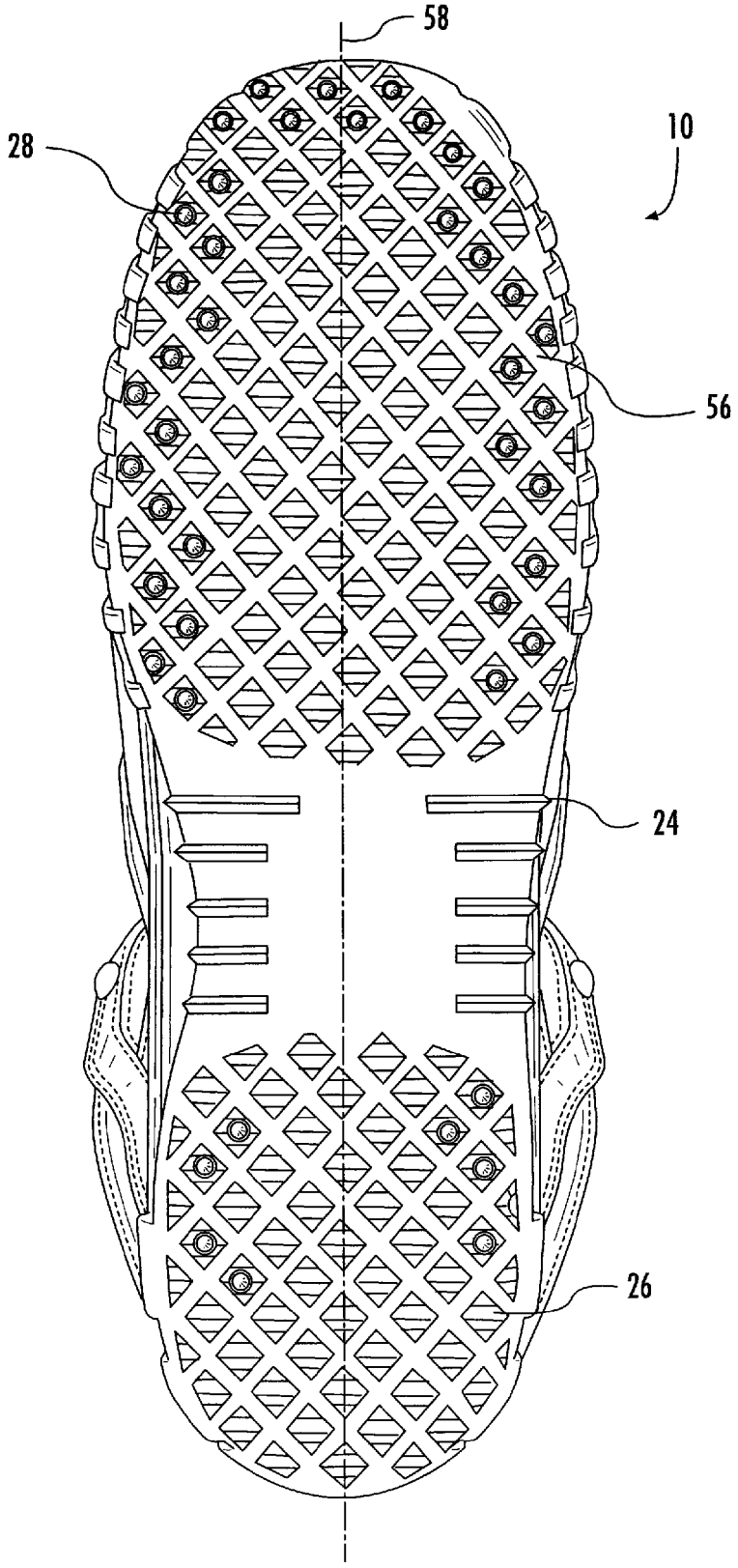
FIG. 2 is a bottom view of a work type shoe utilizing an outsole with tread members of the present invention.
Figure 3:
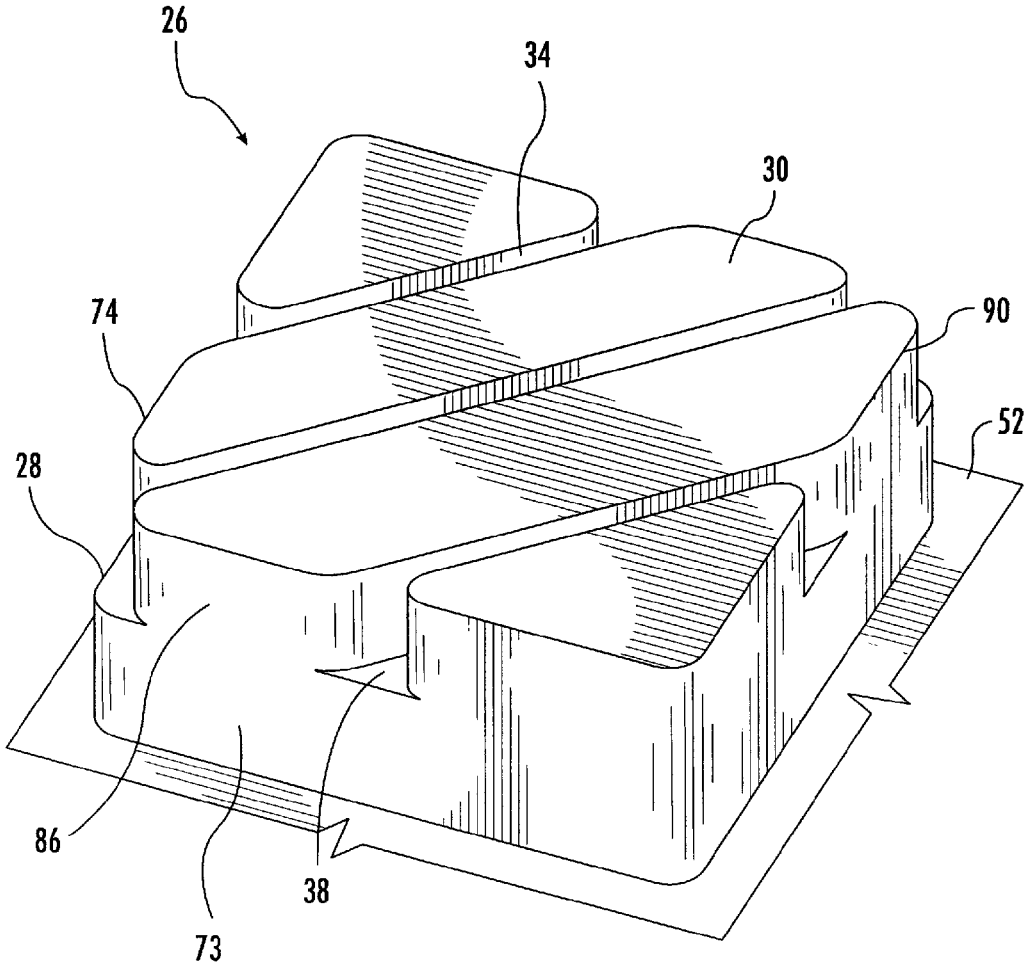
FIG. 3 is a perspective view of a tread member of the present invention.
Figure 4:
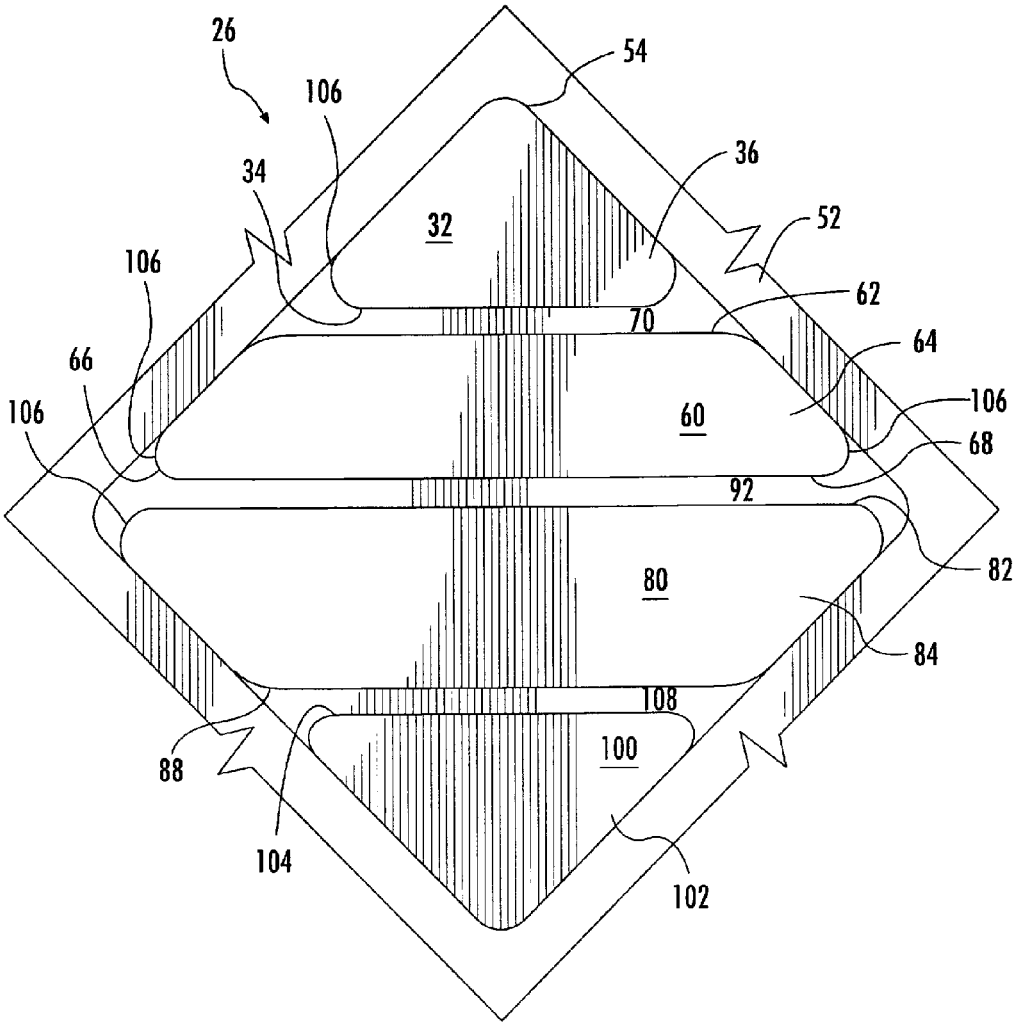
FIG. 4 is a top view of the tread member illustrated in FIG. 2.
Figure 5:
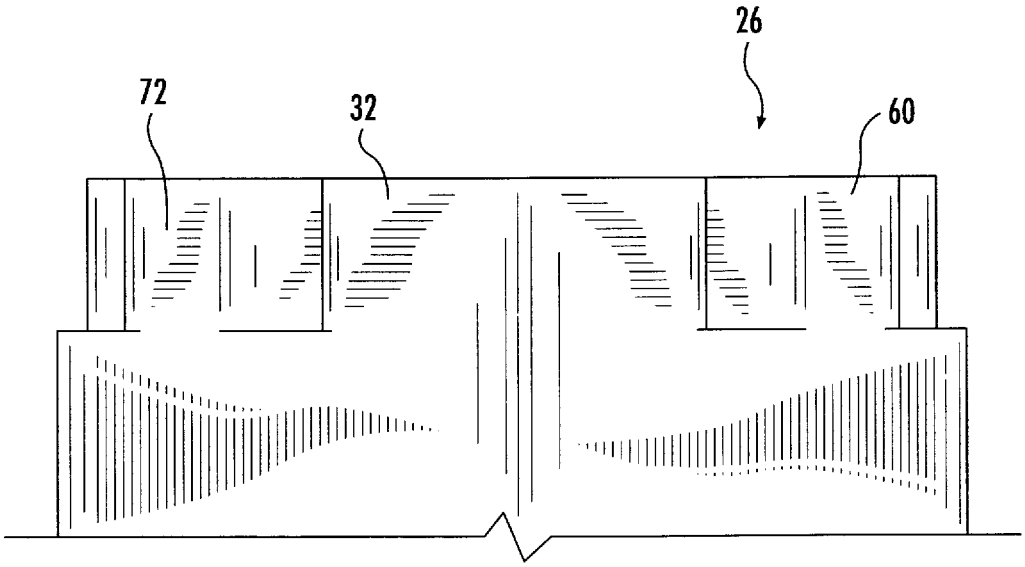
FIG. 5 is a side view of the tread member illustrated in FIG. 2.
Figure 6:
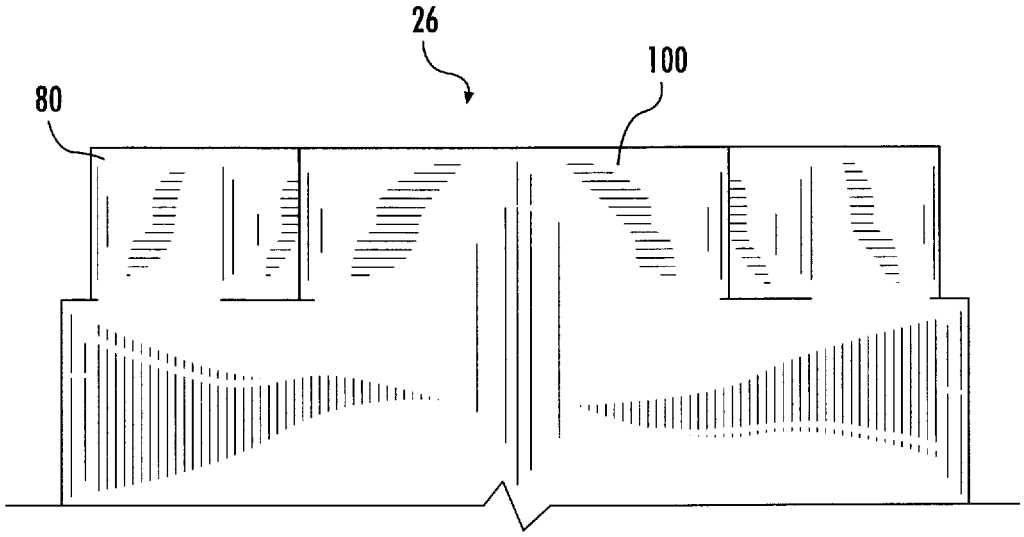
FIG. 6 is a side view of the tread member illustrated in FIG. 2.
Figure 7:
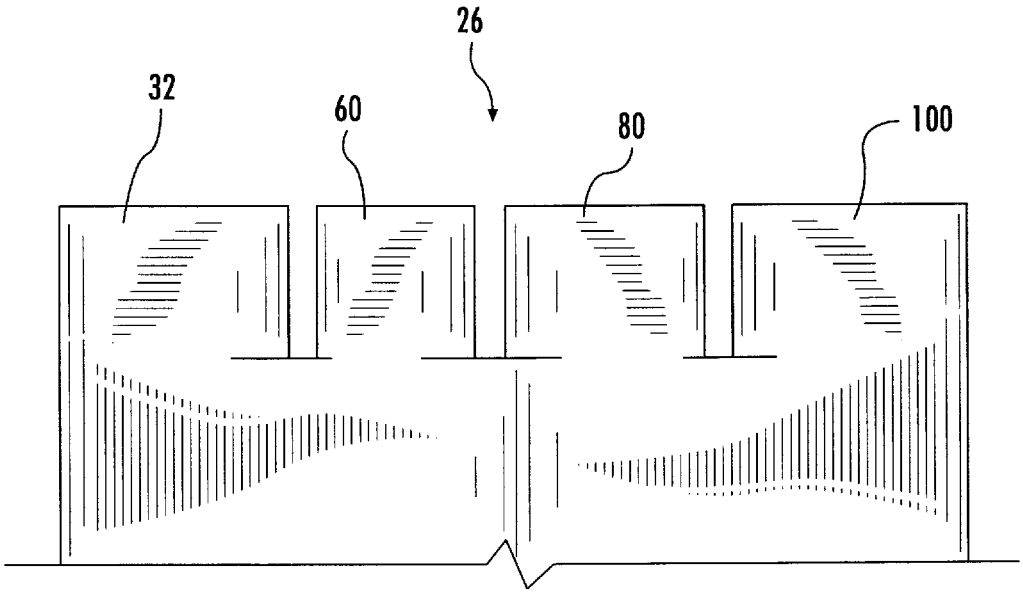
FIG. 7 is a side view of the tread member illustrated in FIG. 2.
Figure 8:
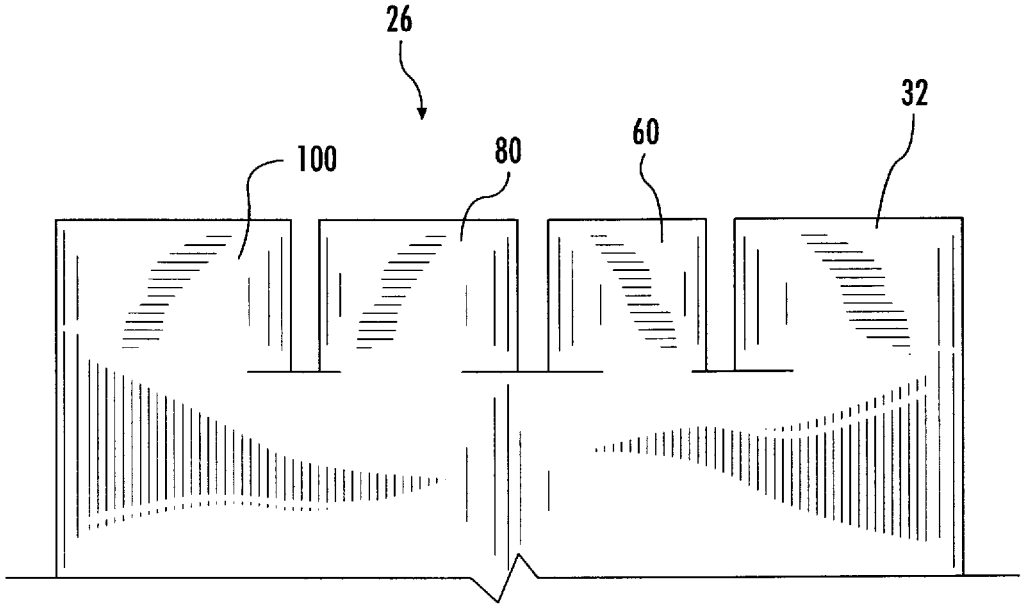
FIG. 8 is a side view of the tread member illustrated in FIG. 2.
Figure 9:
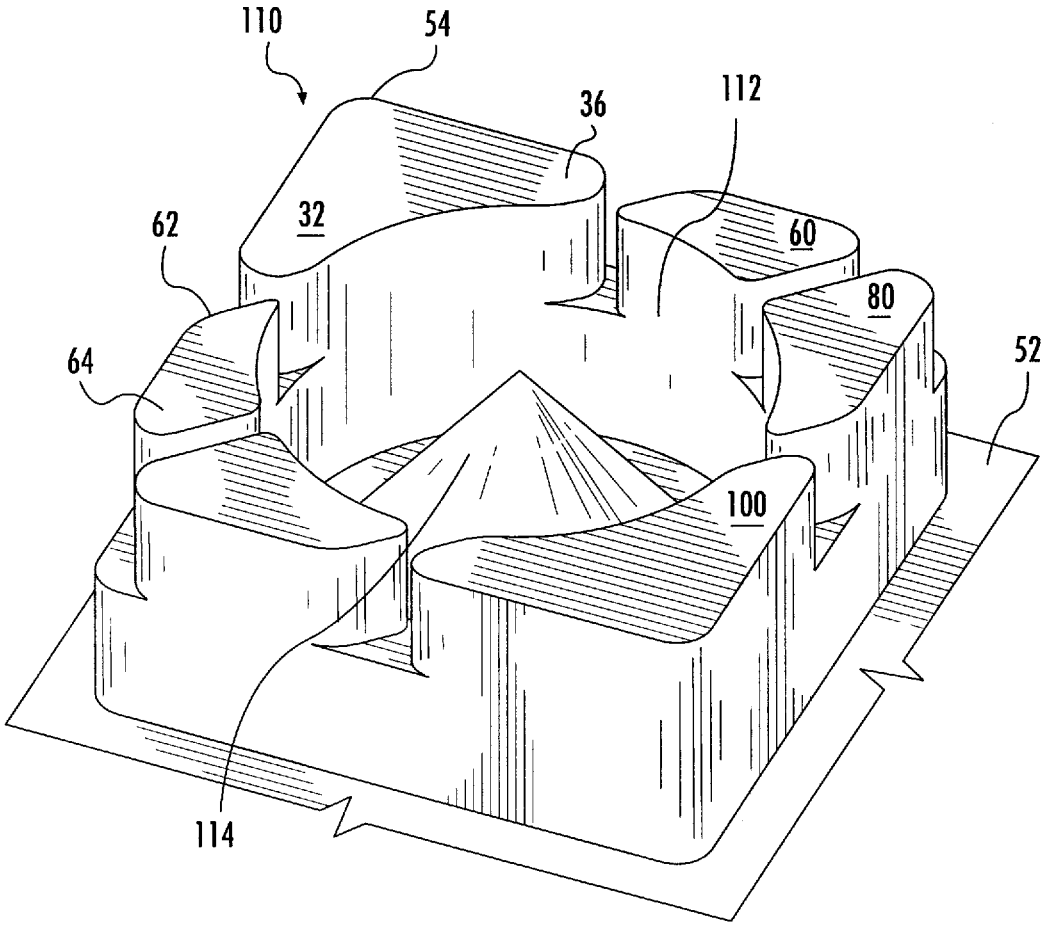
FIG. 9 is a perspective view of a tread member of the present invention.
Figure 10:
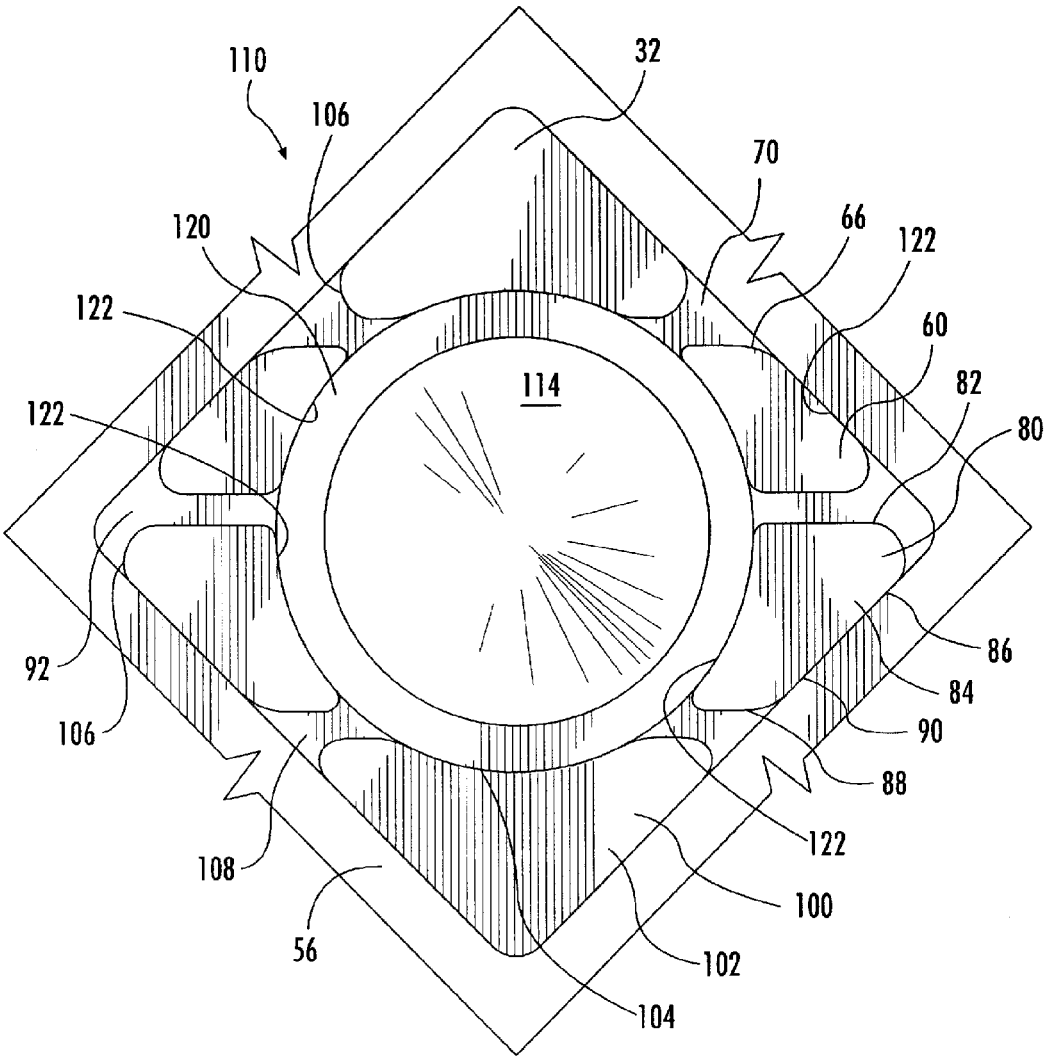
FIG. 10 is a top view of the tread member illustrated in FIG. 9.
Figure 11:
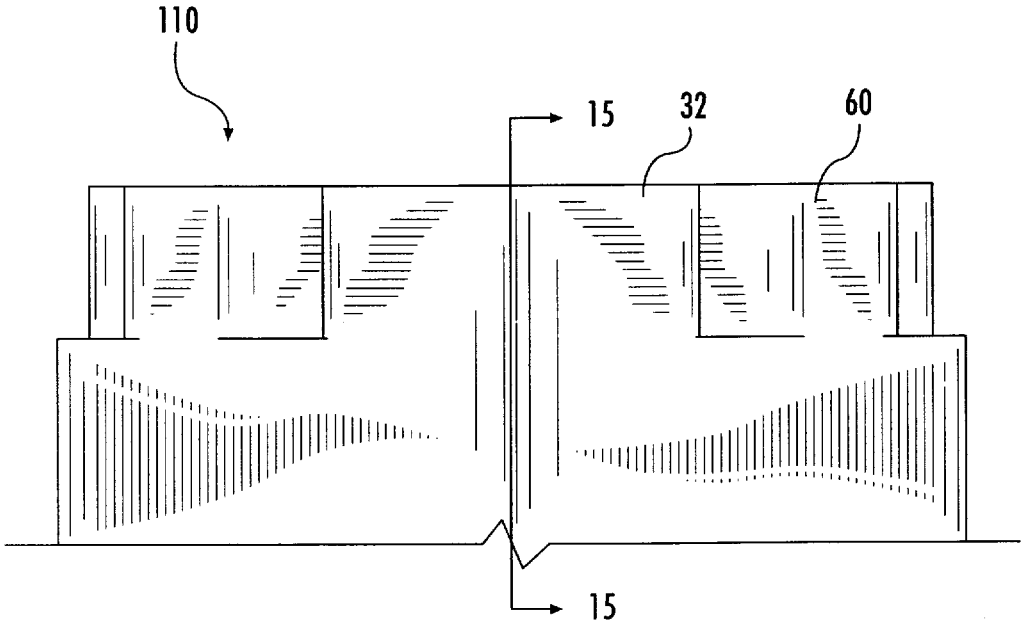
FIG. 11 is a side view of the tread member illustrated in FIG. 9.
Figure 12:
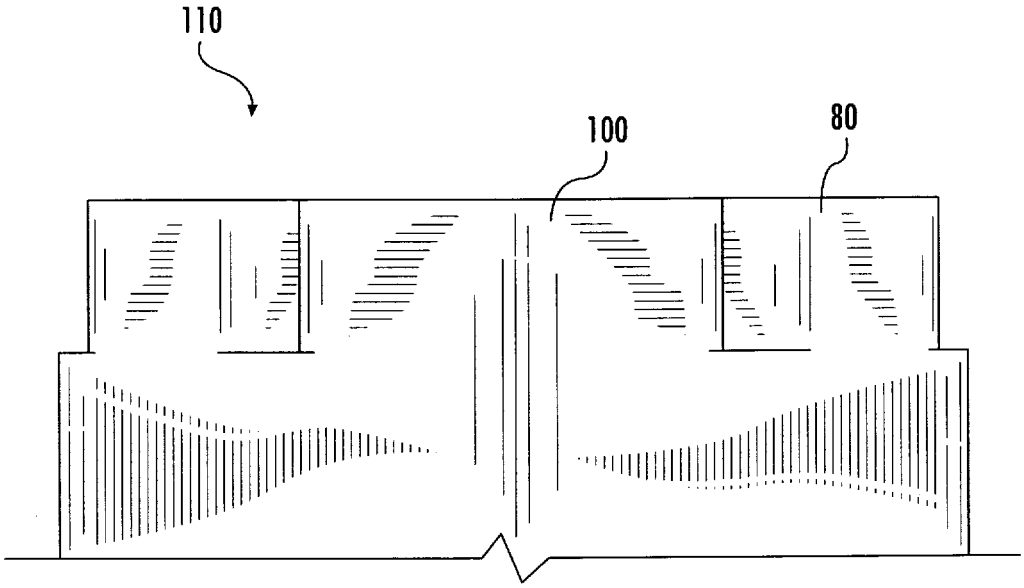
FIG. 12 is a side view of the tread member illustrated in FIG. 9.
Figure 13:
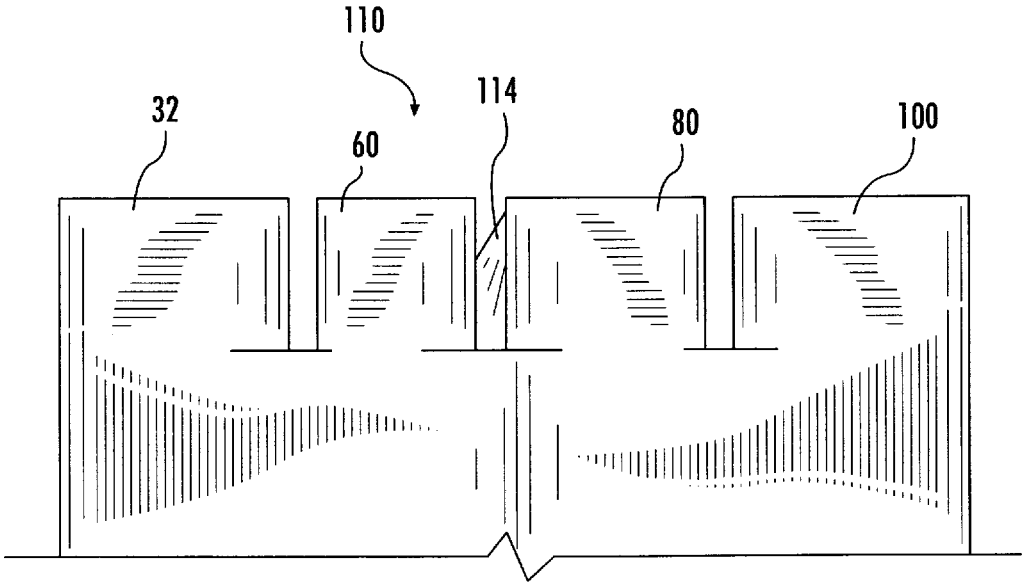
FIG. 13 is a side view of the tread member illustrated in FIG. 9.
Figure 14:
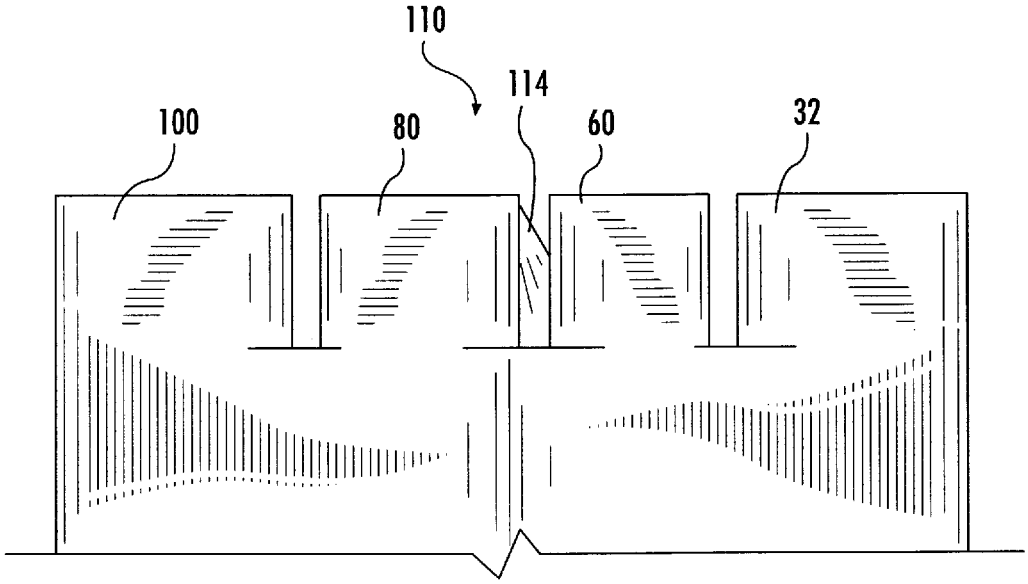
FIG. 14 is a side view of the tread member illustrated in FIG. 9.
Figure 15:
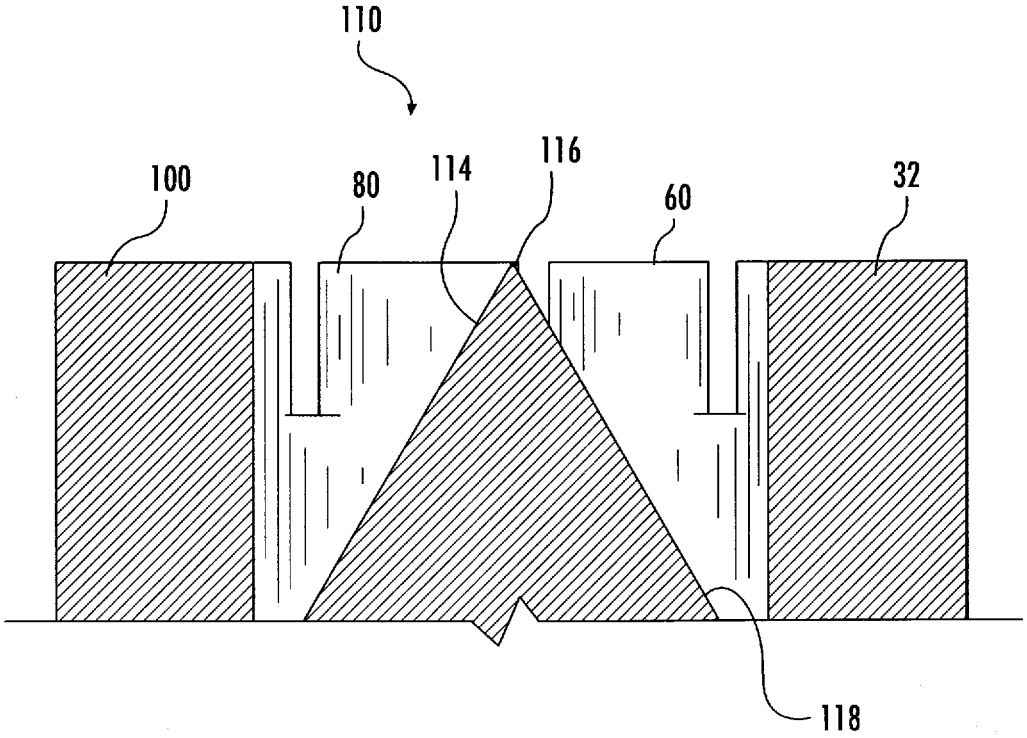
FIG. 15 is a section view taken along lines 15-15 of FIG. 11.
Figure 16:
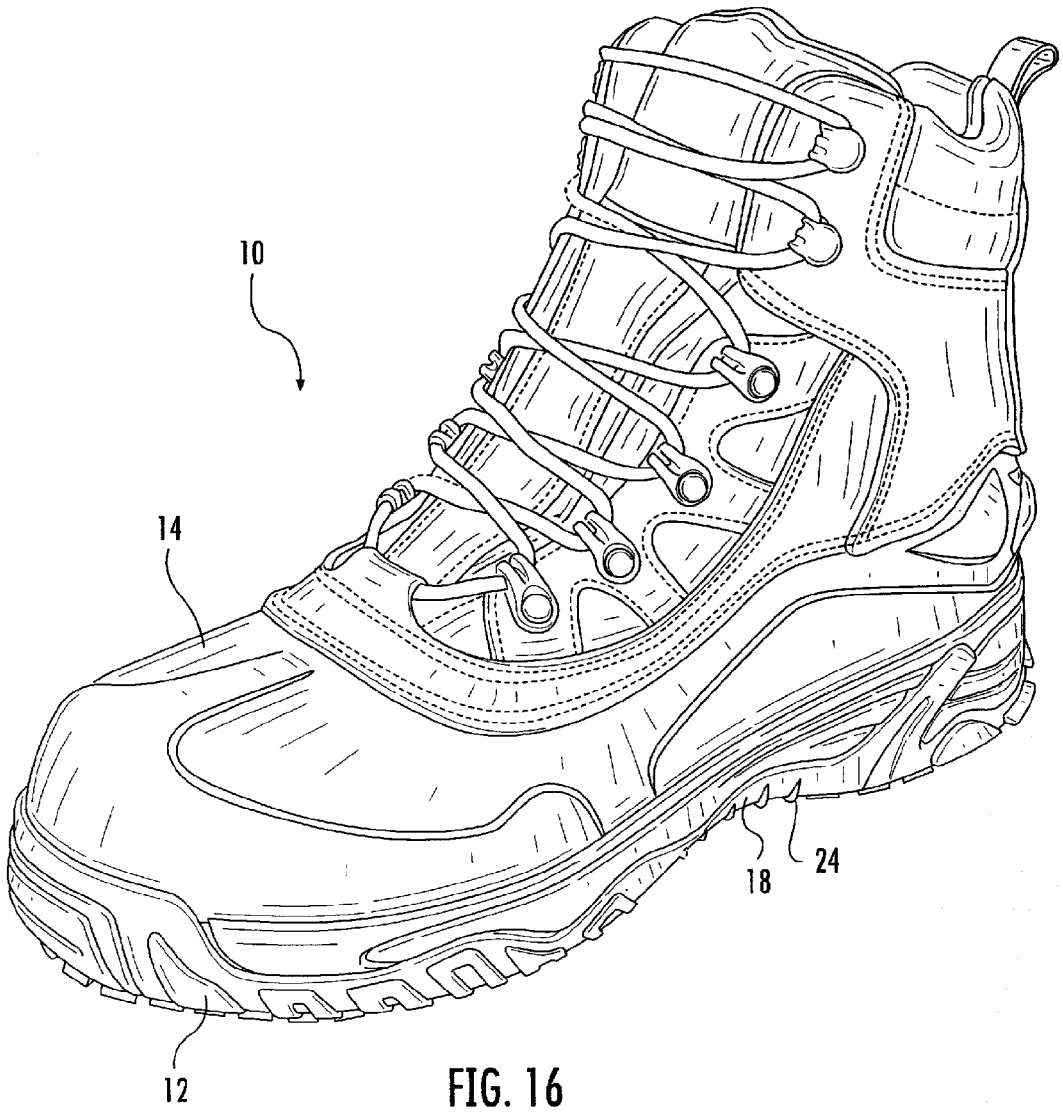
FIG. 16 is a perspective view of a work type shoe utilizing the tread of the present invention.
Figure 17:
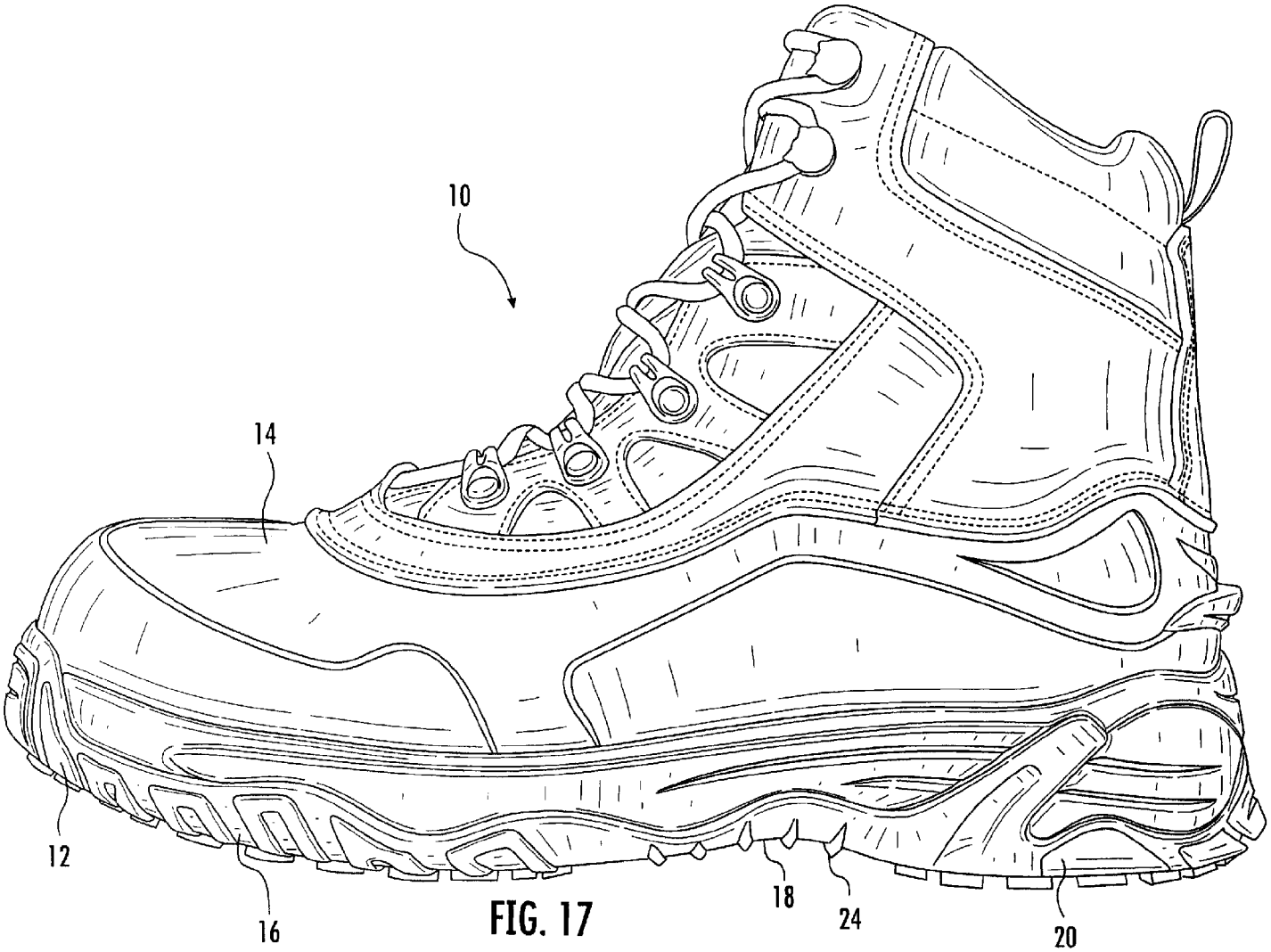
FIG. 17 is a side view of a work type shoe utilizing the tread of the present invention.
Figure 18:
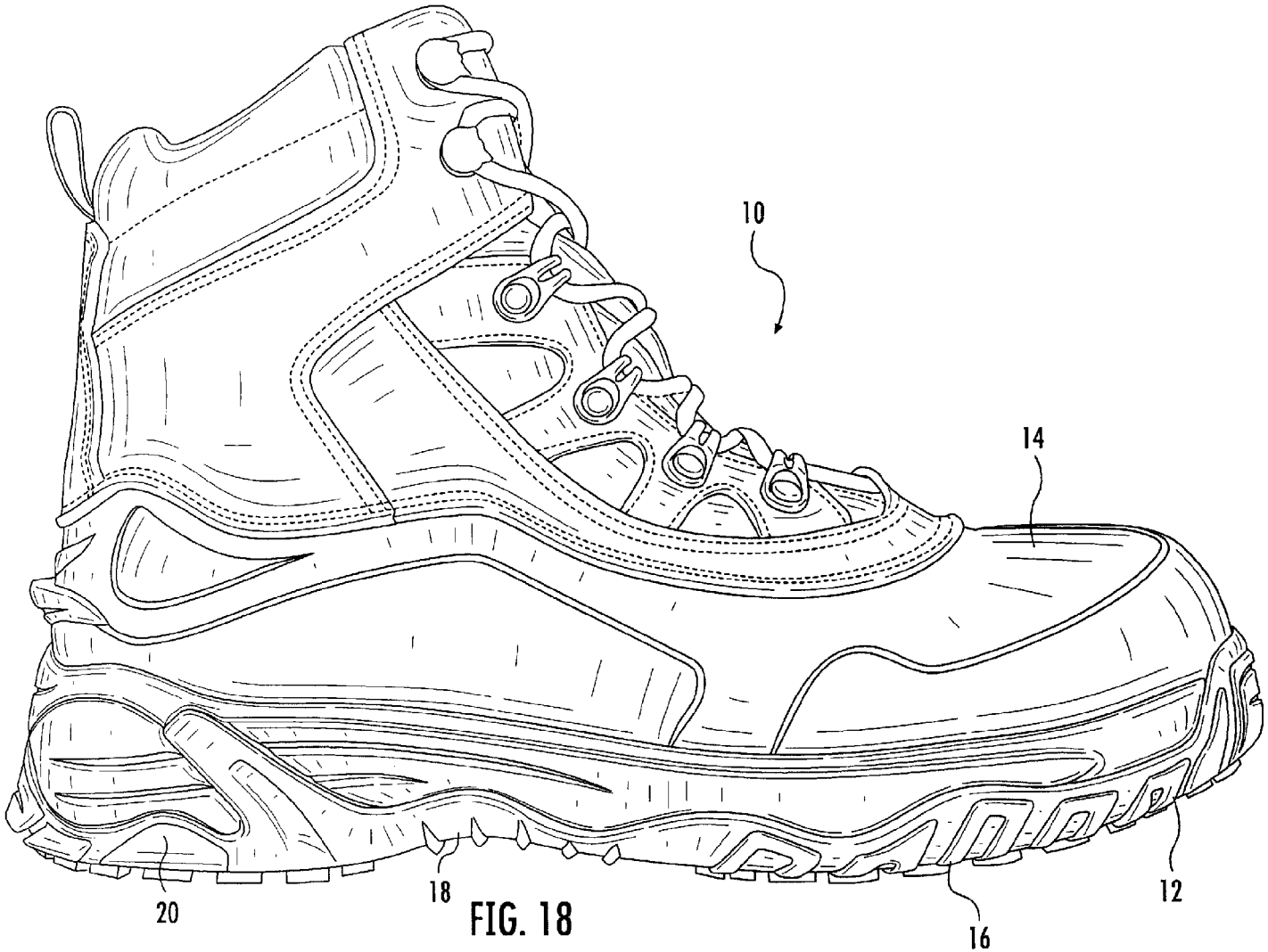
FIG. 18 is a side view of a work type shoe utilizing the tread of the present invention.
Figure 19:
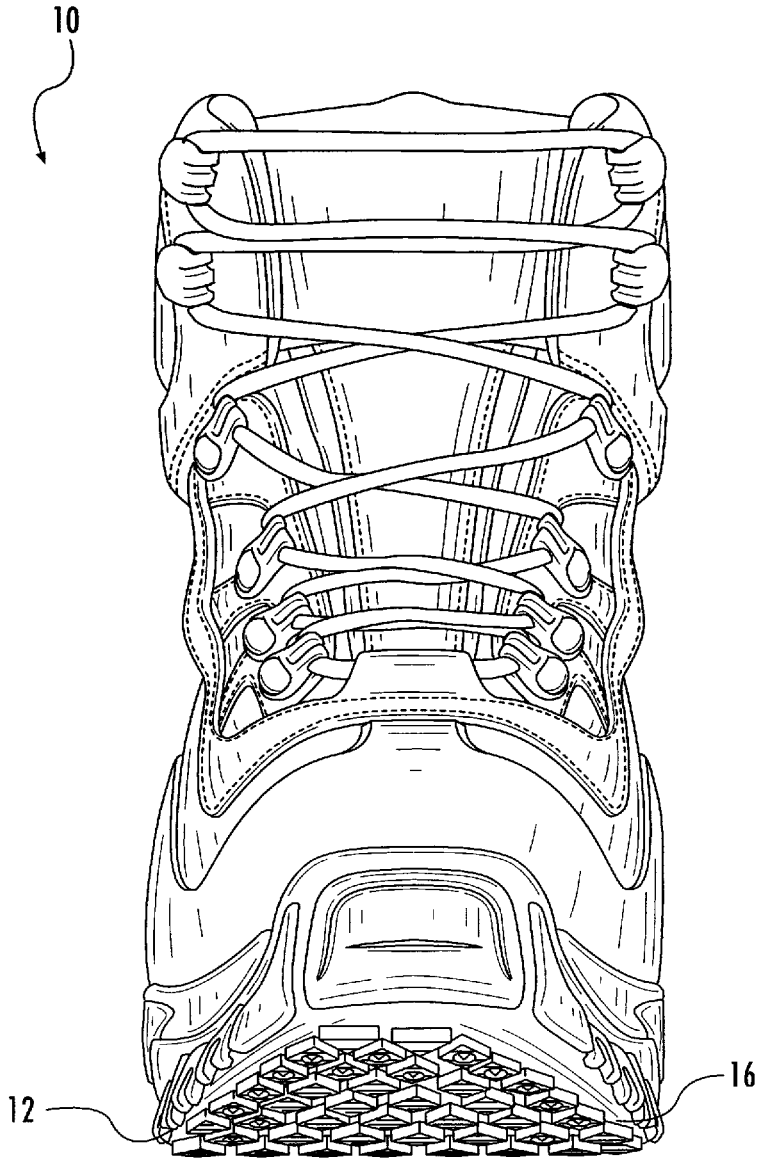
FIG. 19 is a front view of a work type shoe utilizing the tread of the present invention.
Figure 20:
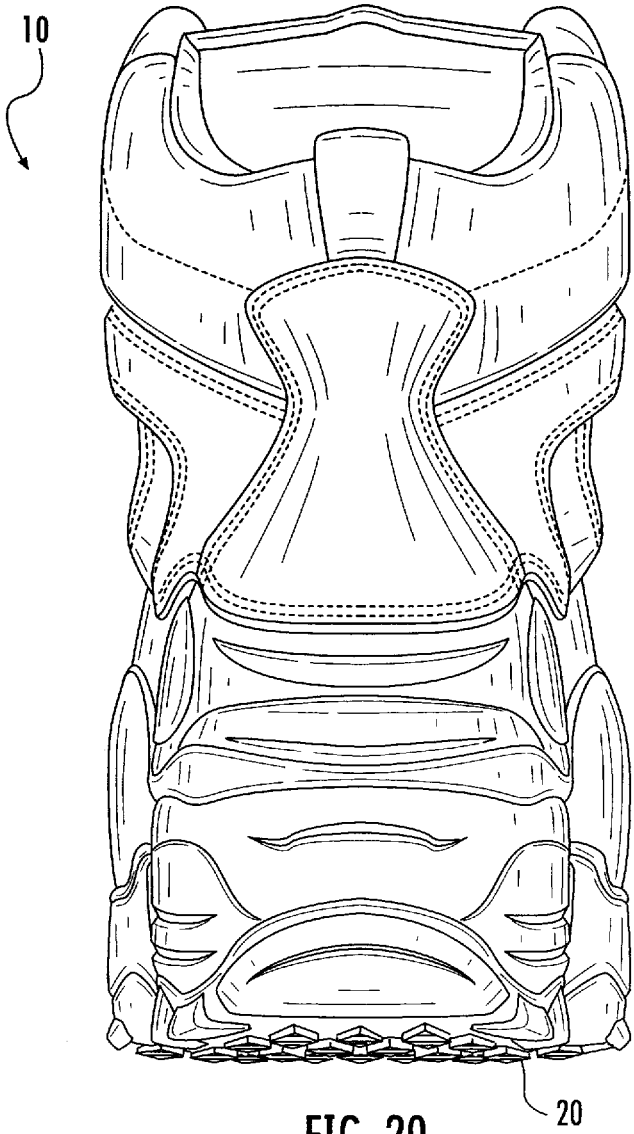
FIG. 20 is a rear view of a work type shoe utilizing the tread of the present invention.

Referring to FIGS. 1-8, the first tread member 22 is illustrated. The first tread member 22 is parallelepiped in shape and extends outwardly from the outsole base surface 52. When viewed from the top, the tread member is substantially square in shape and generally rectangular when viewed from all sides. Each first tread member 22 includes a pedestal 28 that functions to project the tread further outward from the outsole. The pedestal is constructed from the same material as the rest of the outsole, however, its solid block like structure causes it to react to forces as a firmer polymer than the upstanding blades 30 while still being constructed from the same material. The blades 30 represent about half the height of the tread member 22, while the pedestal represents the other half of the height of the tread member 22. The pedestals, and thus the treads, are positioned on the outsole so that a front corner 54 of the pedestal and parting blade 32 face the front portion of the shoe. This positioning creates a V-shape at the front of the tread to push liquid into the channels 56 between the treads. The top surface 36 of the parting blade 32 is substantially flat to cooperate with a floor or ground surface. The rear surface 34 of the parting blade extends substantially orthogonal with respect to the centerline of the shoe 58 (FIG. 2). A first squeegee blade 60 is positioned behind the parting blade and includes a first leading edge 62 and a substantially flat top surface 64 followed by a second rear surface 68. The front and rear surfaces 62, 68 are positioned to be substantially parallel to the rear surface 34 of the parting blade 32. Side surfaces 72 are oriented at about the same angle as the side surfaces of the pedestal 28 side surfaces 73. A substantially sharp corner 66 separates the front, rear and side surfaces 62, 68, 72 from the top surface 60. A first groove 70 is formed by the rear surface of the parting blade 34, the top surface of the pedestal 38, and the first leading edge 62 of the first squeegee blade 60. In operation, the sharp corner 66 functions as if it is constructed from a softer polymer than the outsole to grip the floor or ground surface, allowing the first squeegee blade 60 to flex on the pedestal 28. This causes the squeegee blade to displace water, grease or other fluids into the first groove 70 where it can be directed into the channels 56 and then to the side surfaces 72, formed at an obtuse angle with respect to the first leading edge 62, that direct the fluid away from the tread member, allowing the polymeric rubber compound to cooperate with the working floor or ground surface for adherence.

A second squeegee blade 80 is positioned behind the first squeegee blade 60 and includes a second leading edge 82 and a substantially flat top surface 84 followed by a third rear surface 88. The front and rear surfaces 82, 88 are positioned to be substantially parallel to the rear surface 34 of the parting blade 32. Second side surfaces 86 are oriented at about the same angle as the side surfaces of the pedestal 28 side surfaces 73. A substantially sharp corner 90 separates the front, rear and side surfaces 82, 88, 86 from the top surface 80. A second groove 92 is formed by the rear surface 68 of the first squeegee blade 60, the top surface of the pedestal 38 and the second leading edge 82 of the second squeegee blade 80. In operation, the sharp corner 90 functions as if it is constructed from a softer polymer than the outsole to grip the floor or ground surface, allowing the second squeegee blade 80 to flex on the pedestal 28. This causes the squeegee blade to displace water, grease or other fluids into the second groove 92 where it can be directed into the channels 56 and then to the side surfaces 86, formed at an acute angle with respect to the second leading edge 82, that direct the fluid away from the tread member, allowing the polymeric rubber compound to cooperate with the working floor or ground surface for adherence. As noted earlier, the polymeric and/or rubber compound is such that it conforms to small surface imperfections to adhere to the surface.

A second parting blade 100 is shaped substantially the same as the first parting blade 32. The second parting blade 100 is generally triangular when viewed from the top including a substantially flat top surface 102. The front surface 104 of the second parting blade is substantially flat and extends substantially orthogonal with respect to the centerline of the shoe 58. Corner radii 106 are provided to improve the appearance of the tread while also smoothing the flow of water from the grooves 70, 92, and 108 to the channels.

Referring to FIGS. 1, 2 and 9-15, a second tread 110 of the present invention is illustrated. The second tread 110 is constructed and arranged to penetrate hard, semi-hard or gelatinous surfaces. The second tread is constructed to be identical to the first tread with the exception of a cylindrical cavity 112 formed in the center of the second tread 110. A conical shaped member 114 is formed within the cavity on the base surface 52 of the outsole 12. The conical member 114 is preferably formed from the same polymeric or rubber material as the rest of the outsole 12. The conical member 114 is preferably formed to have about the same height as the remainder of the tread, and has an included angle which provides sufficient rigidity to the material to allow the sharp point 116 (FIG. 15) to penetrate materials on the working surface for traction. In a most preferred embodiment, the base 118 of the conical member is sized to allow a trough 120 to surround the base for containing water, snow, ice debris, etc.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A slip resistant footwear outsole comprising:

an outsole (12) including a forefoot portion (16), a midfoot portion (18) and a heel portion (20), at least one of said portions (12), (16), (20) including a plurality of first tread members (26) constructed from a rubber compound that are particularly suited for channeling liquids from a smooth surface so that said rubber compound can achieve adherence to said smooth surface and a plurality of second tread members (110) particularly suited for penetrating harder materials on a smooth surface, each said first tread member (26) is parallelepiped in shape and extends outwardly from an outsole base surface (52), each said first tread member (26) including a first pedestal (28) that functions to project the tread further outward from the outsole, said pedestal comprising about half the height of each said first tread member (26), each said first tread member positioned on the outsole so that a front corner (54) of the first pedestal and a first parting blade (32) face a front portion of said outsole, said first parting blade and said first pedestal creating a V-shape at the front of each said first tread member (26) to push liquid into channels (56) positioned between said first treads, said first parting blade (32) having a substantially flat top surface (36) for cooperation with a floor surface, said first parting blade (32) including a substantially flat rear surface (34) extending substantially orthogonal with respect to a centerline (58) of said outsole, each said first tread member (26) includes a first squeegee blade (60) positioned behind said first parting blade (32), said first squeegee blade (60) including a leading surface (62) and a substantially flat top surface (64) followed by a rear surface (68), said front and rear surfaces (62), (68) are positioned to be substantially parallel to said rear surface (34) of said first parting blade (32), side surfaces (72) of said first squeegee blade are oriented at about the same obtuse angle as the side surfaces of said pedestal 28 side surfaces, a substantially sharp corner (66) separates said front, rear and side surfaces (62), (68), (72) from said top surface (60) of said first squeegee blade, a first groove (70) is formed by said rear surface (34) of said first parting blade (32), a top surface (38) of said pedestal (28) and said first leading surface (62) of said first squeegee blade (60).

2. The slip resistant footwear of claim 1 wherein said first tread members (26) are positioned in the central or higher weight bearing portions of said outsole (12) while a plurality of second tread members (110) are positioned around the periphery of said outsole (12).

3. The slip resistant footwear outsole of claim 1 wherein a second squeegee blade (80) is positioned behind said squeegee blade (60) and includes a leading surface (82) and a substantially flat top surface (84) followed by a rear surface (88), said front and rear surfaces (82), (88) are positioned to be substantially parallel to said rear surface (34) of said parting blade (32), side surfaces (86) of said second squeegee blade are oriented at about the same angle as the side surfaces of the pedestal (28) side surfaces, a substantially sharp corner (90) separates said front, rear and side surfaces (82), (88), (86) from said top surface (80), a second groove (92) is formed by said rear surface (68) of said squeegee blade (60), said top surface of said pedestal (38) and said leading surface (82) of said second squeegee blade (80).

4. The slip resistant footwear outsole of claim 3 wherein each said first tread member includes a second parting blade (100) shaped substantially the same as said parting blade (32), whereby said second parting blade (100) is generally triangular when viewed from the top including a substantially flat top surface (102), a front surface (104) of the second parting blade is substantially flat and extends substantially orthogonal with respect to said centerline of said outsole.

5. The slip resistant footwear outsole of claim 4 wherein a plurality of vertically oriented corner radii (106) are provided for smoothing the flow of water from said grooves (70), (92), and (108) to said channels (56).

6. The slip resistant footwear outsole of claim 1 wherein said first tread members are made from a slip resistant polymeric material, said slip resistant material having a hardness of about 0.49 Shore, determined by tests performed on a Durometer Hardness Tester.

7. The slip resistant footwear outsole of claim 1 wherein said first tread members are made from a slip resistant polymeric material, said slip resistant material having a slip resistance rating of 0.56-0.65 when tested on a Brungraber Mark 2 Articulated Strut Slip Testing Device.

8. The slip resistant footwear outsole of claim 1 wherein a second tread member (110) is parallelepiped in shape and extends outwardly from the outsole base surface (52), each said second tread member (110) including a pedestal (28) that functions to project the second tread further outward from the outsole, said pedestal comprising about half the height of each said second tread member (110), each said second tread member positioned on the outsole so that a front corner (54) of the pedestal and a second tread member parting blade (32) face the front portion of said outsole, a cavity (112) formed in the center of said pedestal (28), a conical shaped member (114) is formed within the cavity on the base surface (52) of the outsole (12), said second tread member parting blade and said pedestal creating a V-shape at the front of each said second tread member (110) to push liquid into channels (56) between said first treads and said second treads, said second tread member parting blade (32) having a substantially flat top surface (36) for cooperation with a floor surface, said second tread member parting blade including a rear surface (34) extending substantially orthogonal with respect to a centerline (58) of said outsole, said rear surface including a curvature forming a portion of said cavity.

9. The slip resistant footwear outsole of claim 8 wherein each said second tread member (110) includes a squeegee blade (60) positioned behind said second tread member parting blade (32) said squeegee blade including a leading surface (62) and a substantially flat top surface (64) followed by a rear surface (68), said front and rear surfaces (62), (68) are positioned to be substantially orthogonal to said centerline (58) of said outsole, outside surfaces (72) are oriented at about the same obtuse angle as the side surfaces of said pedestal (28) side surfaces, inner side surfaces (122) form a portion of said cavity (112), a substantially sharp corner (66) separates said front, rear and side surfaces (62), (68), (72), (122) from said top surface (60), a groove (70) is formed by said rear surface of said second tread member parting blade (32), said top surface of said pedestal (38) and said leading surface (62) of said squeegee blade (60).

10. The slip resistant footwear outsole of claim 9 wherein a second squeegee blade (80) is positioned behind said squeegee blade (60) and includes a leading surface (82) and a substantially flat top surface (84) followed by a rear surface (88), said front and rear surfaces (82), (88) are positioned to be substantially parallel to said rear surface (34) of said squeegee blade (60), second outside surfaces (86) are oriented at about the same angle as the side surfaces of the pedestal (28) side surfaces, inner side surfaces (122) form a portion of said cavity (112), a substantially sharp corner (90) separates said front, rear and side surfaces (82), (88), (86), (122) from said top surface (80), a second groove (92) is formed by said rear surface of said squeegee blade (60), said top surface of said pedestal (38) and said leading surface (82) of said second squeegee blade (80).

11. The slip resistant footwear outsole of claim 10 wherein each said second tread member (110) includes a second parting blade (100) shaped substantially the same as said parting blade (32), whereby said second parting blade is generally triangular when viewed from the top including a substantially flat top surface (102), a front surface (104) of the second parting blade includes a portion of said cavity (112) and extends substantially orthogonal with respect to said centerline of said outsole.

12. The slip resistant footwear outsole of claim 11 wherein a plurality of vertically oriented corner radii (106) are provided to smoothing the flow of water from said grooves (70), (92), and (108) to said channels (56) between said first tread members and said second tread members.

13. The slip resistant footwear outsole of claim 8 wherein said conical shaped member (114) is preferably formed to have about the same height as the second tread member (110) and has an included angle which provides sufficient rigidity to the material to allow the sharp point (116) to penetrate materials on the working surface for traction.

14. The slip resistant footwear outsole of claim 13 wherein a base (118) of said conical shaped member (114) is sized to allow a trough (120) to surround the base within said cavity (112).

15. A slip resistant footwear outsole comprising:

an outsole (12) including a forefoot portion (16), a midfoot portion (18) and a heel portion (20), at least one of said portions (12), (16), (20) including a plurality of first tread members (26) that are particularly suited for channeling liquids from a smooth surface so that a rubber compound forming said first tread member can achieve adherence to said smooth surface and a plurality of second tread members (110) particularly suited for penetrating harder materials on a smooth surface, each said second tread member (110) is parallelepiped in shape and extends outwardly from an outsole base surface (52), each said second tread member (110) including a pedestal (28) that functions to project the second tread further outward from the outsole, said pedestal comprising about half the height of each said second tread member (22), each said second tread member positioned on the outsole so that a front corner (54) of the pedestal and a second tread member first parting blade (32) faces the front portion of said outsole, a cavity (112) formed in the center of said pedestal (28), a conical shaped member (114) is formed within the cavity on a base surface (52) of the outsole (12), said second tread member parting blade and said pedestal creating a V-shape at the front of each said second tread member (110) to push liquid into channels (56) between said first and said second treads, said second tread member parting blade (32) having a substantially flat top surface (36) for cooperation with a floor surface, said second tread member parting blade including a rear surface (34) extending substantially orthogonal with respect to a centerline (58) of said outsole, said rear surface including a curvature forming a portion of said cavity.

16. The slip resistant footwear outsole of claim (15) wherein each said first tread member (26) is parallelepiped in shape and extends outwardly from an outsole base surface (52), each said first tread member (26) including a pedestal (28) that functions to project the first tread member further outward from the outsole, said pedestal comprising about half the height of each said first tread member (26), each said first tread member positioned on the outsole so that a front corner (54) of the pedestal and a first parting blade (32) face the front portion of said outsole, said first parting blade and said pedestal creating a V-shape at the front of each said first tread member (26) to push liquid into channels (56) between said first tread members and said second tread members, said parting blade (32) having a substantially flat top surface (36) for cooperation with a floor surface, said parting blade (32) including a substantially flat rear surface (34) extending substantially orthogonal with respect to a centerline (58) of said outsole.

17. The slip resistant footwear outsole of claim 16 wherein each said first tread member (26) includes a squeegee blade (60) positioned behind said parting blade (32), said squeegee blade (60) including a leading surface (62) and a substantially flat top surface (64) followed by a rear surface (68), said front and rear surfaces (62), (68) are positioned to be substantially parallel to said rear surface (34) of said parting blade (32), side surfaces (72) of said squeegee blade are oriented at about the same obtuse angle as the side surfaces of said pedestal (28) side surfaces, a substantially sharp corner (66) separates said front, rear and side surfaces (62), (68), (72) from said top surface (60), a first groove (70) is formed by said rear surface (34) of said parting blade (32), a top surface of said pedestal (38) and said leading surface (62) of said squeegee blade (60).

18. The slip resistant footwear outsole of claim (15) wherein said first tread members and said second tread members are made from a slip resistant polymeric material, said slip resistant material having a hardness of about 0.49 Shore, determined by tests performed on a Durometer Hardness Tester.

19. The slip resistant footwear outsole of claim (15) wherein said first tread members and said second tread members are made from a slip resistant polymeric material, said slip resistant material having a slip resistance rating of 0.56-0.65 when tested on a Brungraber Mark 2 Articulated Strut Slip Testing Device.

* * * * *